US007978986B2

(12) United States Patent
Tanaka

(10) Patent No.: US 7,978,986 B2
(45) Date of Patent: Jul. 12, 2011

(54) IMAGE FORMING APPARATUS AND METHOD FOR MONITORING THE DEGREE OF CONSUMPTION OF CONSUMABLE COMPONENTS

(75) Inventor: Hideo Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 400 days.

(21) Appl. No.: 12/186,809

(22) Filed: Aug. 6, 2008

(65) Prior Publication Data

US 2009/0041483 A1 Feb. 12, 2009

(30) Foreign Application Priority Data

Aug. 8, 2007 (JP) ..... 2007-206762
Jun. 23, 2008 (JP) ..... 2008-163464

(51) Int. Cl.
*G03G 15/00* (2006.01)

(52) U.S. Cl. ..... 399/24

(58) Field of Classification Search ..... 399/24, 399/26, 27, 31
See application file for complete search history.

(56) References Cited

U.S. PATENT DOCUMENTS 6,421,137 B1 * 7/2002 Endo ..... 358/1.16
6,631,248 B2 * 10/2003 Serizawa ..... 399/27
7,403,724 B2 * 7/2008 Yamaguchi ..... 399/27
2007/0122166 A1 * 5/2007 Takahashi et al. ..... 399/24

FOREIGN PATENT DOCUMENTS

JP 11327381 A * 11/1999
JP 2003-91218 3/2003
JP 2004361544 A * 12/2004

* cited by examiner

*Primary Examiner* — Robert Beatty
(74) *Attorney, Agent, or Firm* — Oblon, Spivak, McClelland, Maier & Neustadt, L.L.P.

(57) ABSTRACT

Upon generation of an image forming request, a control unit sets a request flag in a nonvolatile rewritable memory. A toner consumption monitoring unit calculates amount of toner consumption during a process of image formation based on the image forming request and the request flag. Upon completion of the process of image formation, the control unit deletes the request flag from the memory unit. Thus, it becomes possible to determine whether the amount of toner consumption is correctly updated based on the request flag and accurately monitor the amount of toner consumption.

15 Claims, 6 Drawing Sheets

FIG. 7

| REQUEST TYPE \ NUMBER OF PIXELS | | Y | M | C | Bk |
|---|---|---|---|---|---|
| PRINTING REQUEST | A3 | 69905052 | 69905052 | 69905052 | 69905052 |
| | A4 | 34802527 | 34802527 | 34802527 | 34802527 |
| | A5 | 17342673 | 17342673 | 17342673 | 17342673 |
| | B4 | 52199886 | 52199886 | 52199886 | 52199886 |
| | B5 | 26099943 | 26099943 | 26099943 | 26099943 |
| TONER-MARK-IMAGE FORMING REQUEST | | 407808 | 407808 | 407808 | 407808 |
| PATTERN IMAGE FORMING REQUEST | | 664104 | 664104 | 664104 | 664104 |

IMAGE FORMING APPARATUS AND METHOD FOR MONITORING THE DEGREE OF CONSUMPTION OF CONSUMABLE COMPONENTS

CROSS-REFERENCE TO RELATED APPLICATIONS

The present application claims priority to and incorporates by reference the entire contents of Japanese priority document 2007-206762 filed in Japan on Aug. 8, 2007 and Japanese priority document 2008-163464 filed in Japan on Jun. 23, 2008.

BACKGROUND OF THE INVENTION

1. Field of the Invention

The present invention relates to a technology of monitoring degree of consumption of consumable components in an image forming apparatus.

2. Description of the Related Art

An image forming apparatus such as a copying machine or a printer forms an image on an image forming medium such as a sheet of printing paper by using an image forming material such as toner or ink. Image forming apparatuses include consumable components such as a photosensitive member and toner. Use of a consumable component after its life is over can lead to degradation of the image quality. Japanese Patent Application Laid-open No. 2003-91218 discloses a technology to monitor the wear and tear of the consumable components in an image forming apparatus and use the data to suppress degradation of the image quality.

Concretely, for example, amount of toner consumption in an image forming apparatus is estimated, and based on the estimated amount the user of the image forming apparatus is notified whether it is necessary to refill toner in the toner container.

The amount of toner consumption can be estimated by detecting the amount of toner in the toner container by using a sensor, or can be estimated based on the number of times the process of image formation has been performed. The amount of toner consumption can also be estimated based on various image forming conditions such as the paper size on which an image to be formed or the resolution at which the image is to be formed.

The value of the amount of toner consumption is stored in a nonvolatile rewritable memory. However, if for some reason the power supply to the image forming apparatus is temporarily discontinued before a new value of the amount of toner consumption, that is, the value of the amount of toner consumption obtained during the latest process of image formation, is stored in the memory, then it becomes difficult to accurately monitor the amount of toner consumption upon power restoration. Thus, e.g., even if large amount of toner is consumed during the latest process of image formation, the user might not be notified that it is necessary to refill the toner before subsequent process of image formation.

SUMMARY OF THE INVENTION

It is an object of the present invention to at least partially solve the problems in the conventional technology.

According to an aspect of the present invention, there is provided an image forming apparatus that forms an image on an image forming medium according to an image forming request. The image forming apparatus includes an image forming unit that, upon receiving the image forming request, executes a process of image formation with respect to an image forming medium; a storage unit that stores therein a request flag in the event that the image forming unit has received the image forming request, and stores therein a value indicative of degree of consumption of a consumable member used in the process of image formation; and a monitoring unit that monitors current degree of consumption of the consumable member, wherein the monitoring unit updates the value in the storage unit to a new value based on contents of the image forming request and whether the request flag is stored in the storage unit and deletes the request flag from the storage unit after updating the value.

According to still another aspect of the present invention, there is provided an image forming method for forming an image on an image forming medium according to an image forming request. The image forming apparatus includes an image forming unit that, upon receiving the image forming request, executes a process of image formation with respect to an image forming medium; a storage unit that stores therein data; and a monitoring unit that monitors current degree of consumption of the consumable member. The image forming method includes the storage unit storing therein a request flag in the event that the image forming unit has received the image forming request, and storing therein a value indicative of degree of consumption of a consumable member used in the process of image formation; the monitoring unit updating the value in the storage unit to a new value based on contents of the image forming request and whether the request flag is stored in the storage unit and deletes the request flag from the storage unit after updating the value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a table for explaining total number of pixels used in a process of image formation at a particular resolution according to each type of image forming request.

DETAILED DESCRIPTION OF THE PREFERRED EMBODIMENTS

Exemplary embodiments of the present invention are described in detail below with reference to the accompanying drawings. The present invention is not limited to these exemplary embodiments.

In the following embodiments, the present invention is implemented in a tandem color laser printer. However, the present invention can be implemented in any other type of image forming apparatus. For example, the present invention can be implemented in a monochrome laser printer, a color copying machine, or a monochrome copying machine that performs electrostatic image forming, or in an ink-jet printer that performs ink-jet image forming.

Figure 3:
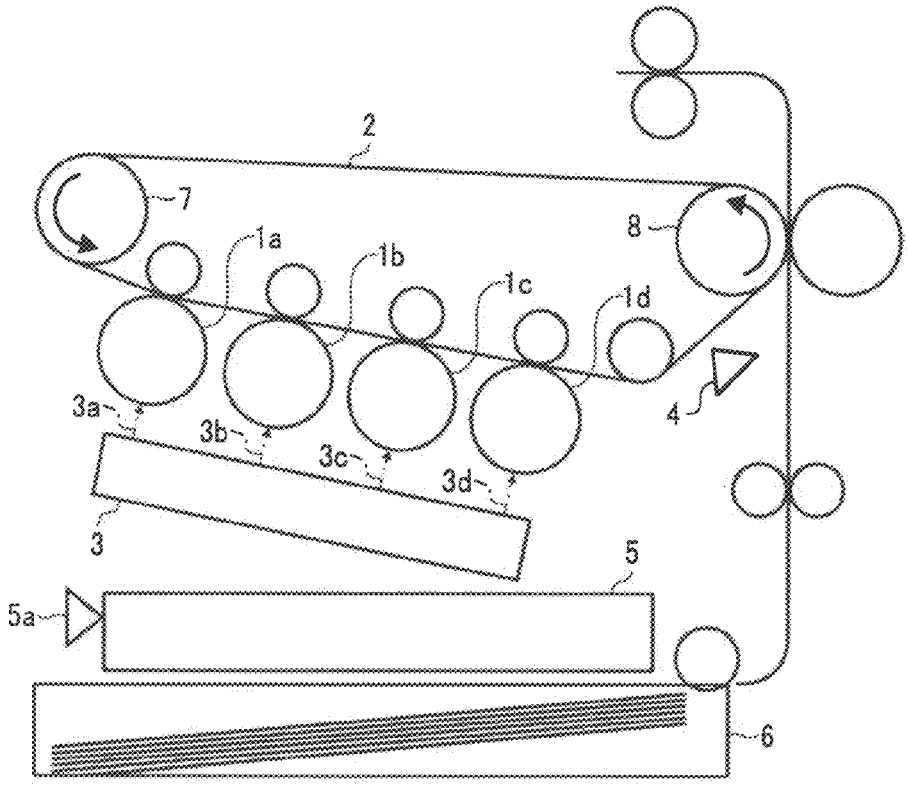
FIG. 3 is a schematic diagram of the image forming apparatus.

FIG. 3 is a schematic diagram of a tandem color laser printer according to an embodiment of the present invention. In the tandem color laser printer, a light exposing unit 3 exposes each of four photosensitive members 1*a* to 1*d* to light with laser beams 3*a* to 3*d*, respectively. As a result, an electrostatic latent image is formed on each of the photosensitive members 1*a* to 1*d*. Subsequently, a developing unit (not shown) transfers a cyan toner, a yellow toner, a magenta toner, and a black toner to the photosensitive members 1*a* to 1*d*, respectively, such that each electrostatic latent image is developed into a single color toner image of corresponding toner color. A primary transfer unit arranged for each of the photosensitive members 1*a* to 1*d* then primary-transfers the corresponding single color toner image on an intermediate transfer belt 2 such that a full color toner image is formed thereon. The intermediate transfer belt 2 is stretched around a driving roller 8 and a driven roller 7. The driving roller 8 rotates the intermediate transfer belt 2 in anticlockwise direction. A paper feeding tray 6 is arranged in the bottom part of the tandem color laser printer. A plurality of sheets of printing paper can be stacked in the paper feeding tray 6. A sheet in the paper feeding tray 6 is conveyed to a secondary transfer nip formed at the driving roller 8 at such a timing that the full color toner image on the intermediate transfer belt 2 is secondary-transferred on the sheet. Subsequently, a cleaning unit (not shown) removes residual toner from the intermediate transfer belt 2. The residual toner is collected in a residual toner collecting box 5 arranged beneath the light exposing unit 3. A residual toner detecting sensor 5*a* is arranged to detect the amount of residual toner in the residual toner collecting box 5.

Meanwhile, the single color toner image on each of the photosensitive members 1*a* to 1*d* is sequentially primary-transferred and superimposed on the intermediate transfer belt 2. During that process, if there is a slight midway fluctuation in the rotating speed of the intermediate transfer belt 2, then the position at which the single color toner images are superimposed varies in a sub-scanning direction (i.e., along the rotating direction of the intermediate transfer belt 2) by a small amount. That causes color shift in the full color toner image along the sub-scanning direction thereby deteriorating the image quality. Moreover, fluctuation in surrounding conditions such as temperature can cause variation in the magnification ratio of the light exposing unit 3 in a main scanning direction (i.e., perpendicular to the rotating direction of the intermediate transfer belt 2) or variation in the start timing for exposure of the light exposing unit 3. In that case, color shift also occurs along the main scanning direction. To prevent such color shift, a toner mark image is formed as a position adjusting image on the intermediate transfer belt 2 before a full color toner image is formed thereon. An image detecting sensor 4 arranged close to the secondary transfer nip detects the toner mark image such that the degree of color shift of each color can be calculated based on the detected toner mark image. The color shift is then corrected by adjusting the magnification ratio or the start timing for exposure of the light exposing unit 3. Such a method of color shift correction by using a toner mark image is conventionally known. Thus, the detailed description thereof is not given herein.

Figure 4:
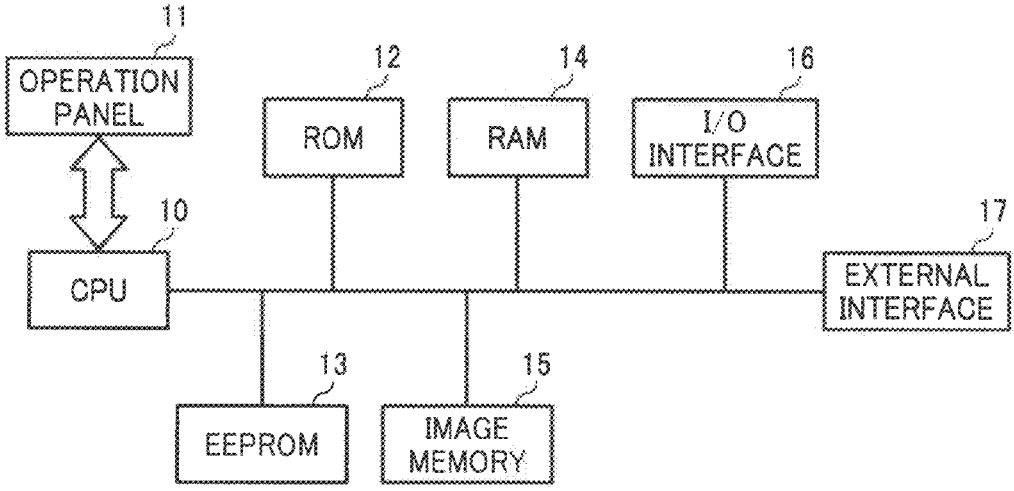
FIG. 4 is a block diagram for explaining a hardware configuration of a control system of the image forming apparatus.

FIG. 4 is a block diagram for explaining a hardware configuration of a control system of the tandem color laser printer. The control system is configured with a central processing unit (CPU) 10, an operation panel 11, a read only memory (ROM) 12, an electronically erasable and programmable read only memory (EEPROM) 13, a random access memory (RAM) 14, an image memory 15, an input-output (I/O) interface 16, and an external interface 17 that is connected to the control system via a control bus and a data bus.

The CPU 10 executes software programs stored in the ROM 12 such that various image forming functions are performed in the tandem color laser printer. The operation panel 11 includes a display unit (not shown) such as a liquid crystal display (LCD) panel and an input unit (not shown) such as a key switch. On the one hand, the operation panel 11 obtains a variety of information including the degree of wear and tear of the photosensitive members 1*a* to 1*d* or the amount of toner consumption during image formation, and displays that information on the display device. On the other hand, the operation panel 11 receives user setting, such as paper size setting or printing resolution setting, that is input through the input unit, and sends that information to the CPU 10. The information regarding the degree of wear and tear of the photosensitive members 1*a* to 1*d* or the amount of toner consumption is stored in the EEPROM 13. The I/O interface 16 interfaces the CPU 10 with sensors (e.g. the residual toner detecting sensor 5*a* and the image detecting sensor 4) and electrical components (not shown) (e.g., motors and/or clutches) for signal communication. The external interface 17 is compatible to one or more communication standards such as 100Base-TX, USB2.0, IEEE 1284, and interfaces the CPU 10 with an external device such as a user computer connected by a communication cable. The image data for printing sent by the user computer is stored in the image memory 15.

Figure 1:
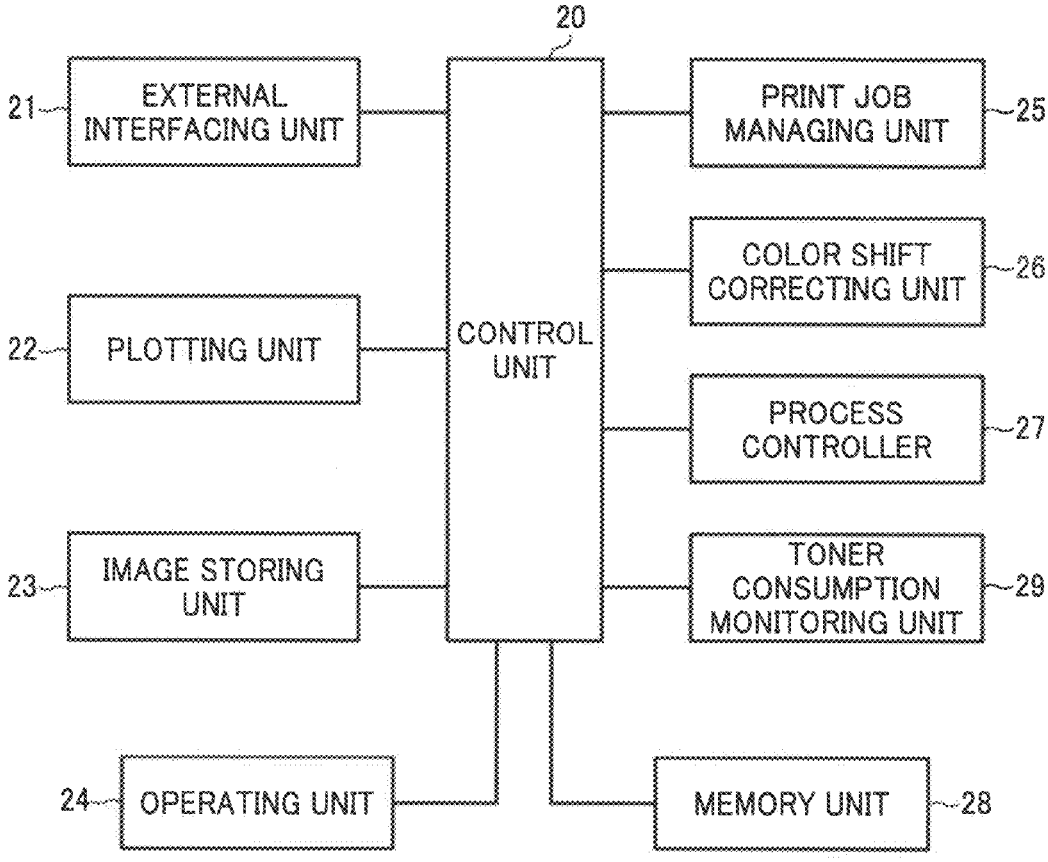
FIG. 1 is a block diagram for explaining a functional configuration of an image forming apparatus according to an embodiment of the present invention.

FIG. 1 is a block diagram for explaining a functional configuration of the tandem color laser printer. The tandem color laser printer includes a control unit 20, an external interfacing unit 21, a plotting unit 22, an image storing unit 23, an operating unit 24, a print job managing unit 25, a color shift correcting unit 26, a process controller 27, a memory unit 28, and a toner consumption monitoring unit 29.

The external interfacing unit 21 corresponds to the external interface 17 and it is used for communication with the user computer. The plotting unit 22 corresponds to the image forming components such as the photosensitive members 1*a* to 1*d*, the light exposing unit 3, the intermediate transfer belt 2. Under the control of the control unit 20, the plotting unit 22 performs the process of image formation by using data such as the image data for printing or toner mark image data stored in the image storing unit 23, which corresponds to the image memory 15. The image data for printing can include various types of data such as text data, picture data, graphic data, or a combination thereof. A printing request issued by the user includes information regarding the type of image data for printing, the paper size on which the image data is to be printed (e.g., A4 size, A3 size, B5 size, B4 size, etc.), and the printing resolution (e.g., 300 dots per inches (dpi), 600 dpi, etc.).

The operating unit 24 corresponds to the operation panel 11. The print job managing unit 25 manages the order in which print jobs are printed. The control unit 20 controls the process of image formation in entirety. Each of the functional components shown in FIG. 1 is put into practice when the CPU 10 executes a corresponding software program stored in the ROM 12.

The color shift correcting unit 26 sends a toner-mark-image forming request to the control unit 20 such that a toner mark image is formed on the intermediate transfer belt 2. Subsequently, based on the position of the toner mark image detected by the image detecting sensor 4, the color shift correcting unit 26 corrects the color shift of each color. The process of color shift correction by using the toner mark image is conventionally known as disclosed in Japanese Patent Application Laid-open No. H11-65208 or Japanese Patent Application Laid-open No. 2002-244393. Thus, the detailed description thereof is not given herein.

The process controller 27 sends a pattern image forming request to the control unit 20 such that a pattern image is formed on the intermediate transfer belt 2. The pattern image is used for process control adjustment described below. When the image detecting sensor 4 detects the pattern image, the process controller 27 performs process control adjustment based on the image density of the pattern image. Generally, in an electrostatic image forming apparatus, the properties of image forming components such as a charging unit, a light exposure unit, a photosensitive member, a developing unit are subject to variation due to fluctuation in surrounding conditions such as temperature and humidity or due to wear and tear over time. Such variation in the properties of the image forming components affects the image quality. To maintain the image quality, conventionally, the conditions under which the process of image formation is performed are controlled depending on the variation in the properties of the image forming components. More particularly, to maintain the image quality, the image density of the pattern image is compared with a standard image density. Based on the comparison, a developing bias (e.g., charging voltage applied by the charging unit) is adjusted such that the difference between the image density of the pattern image and the standard image density decreases. That facilitates in regulating image density of a full color toner image. Such adjustment of image density for achieving stable image quality is referred to as the process control adjustment. The process control adjustment is conventionally known as disclosed in Japanese Patent Application Laid-open No. H11-167248 or Japanese Patent Application Laid-open No. H8-262820. Thus, the detailed description thereof is not given herein.

When the process of image formation is performed according to a printing request, the toner consumption monitoring unit 29 calculates the amount of toner consumption of each color based on the information such as the paper size, the printing resolution, and the type of image data for printing that is included in the printing request. On the other hand, when the process of image formation is performed according to a toner-mark-image forming request or a pattern image forming request, the toner consumption monitoring unit 29 calculates the amount of toner consumption of each color based on the corresponding information. Subsequently, the toner consumption monitoring unit 29 updates a toner consumption database of each color stored in the memory unit 28, which corresponds to the EEPROM 13, with the latest calculated amount of toner consumption of each color. Meanwhile, the toner of each color is filled in a replaceable toner cartridge. When the amount of unused toner in a toner cartridge drops below a predetermined threshold, it is necessary to replace the toner cartridge to maintain the image quality. In such a case, the toner consumption monitoring unit 29 transmits a cartridge empty signal to the control unit 20. Subsequently, the control unit 20 displays the status of the empty toner cartridge on the operating unit 24, which corresponds to the operation panel 11, such that the user can replace the toner cartridge in time.

Thus, every time the process of image formation is performed according to a printing request or according to either one of a toner-mark-image forming request and a pattern image forming request, the toner consumption monitoring unit 29 calculates the amount of toner consumption of each color and updates the toner consumption database with the calculated amount of toner consumption. However, if for some reason the power supply to the tandem color laser printer is temporarily discontinued such that the process of image formation is interrupted, then there is a possibility that the toner consumption monitoring unit 29 cannot update the toner consumption database with the amount of toner consumption calculated prior to the interruption. In that case, the un-updated toner consumption database is used when the process of image formation resumes upon power restoration. Because of the un-updated toner consumption database, a toner cartridge in which the amount of unused toner has dropped below a predetermined threshold might be used to form a toner image. The toner deficiency caused by using such a toner cartridge results in deterioration in the image quality.

To solve such a problem, upon generation of an image forming request (e.g., a printing request, a toner-mark-image forming request, or a pattern image forming request), the control unit 20 sets a request flag in the memory unit 28. Subsequently, when the process of image formation is performed according to the image forming request and when the toner consumption database is updated, the control unit 20 deletes the request flag from the memory unit 28. However, if the process of image formation is interrupted due to a problem such as temporary power discontinuity, then the request flag remains set in the memory unit 28. In that case, the toner consumption monitoring unit 29 determines that the toner consumption database is not yet updated because of the interruption in the process of image formation. Consequently, the toner consumption monitoring unit 29 calculates the amount of toner consumption of each color and updates the toner consumption database with the calculated amount of toner consumption. As a result, upon power restoration, the process of image formation can be resumed by using the updated toner consumption database.

Figure 2:
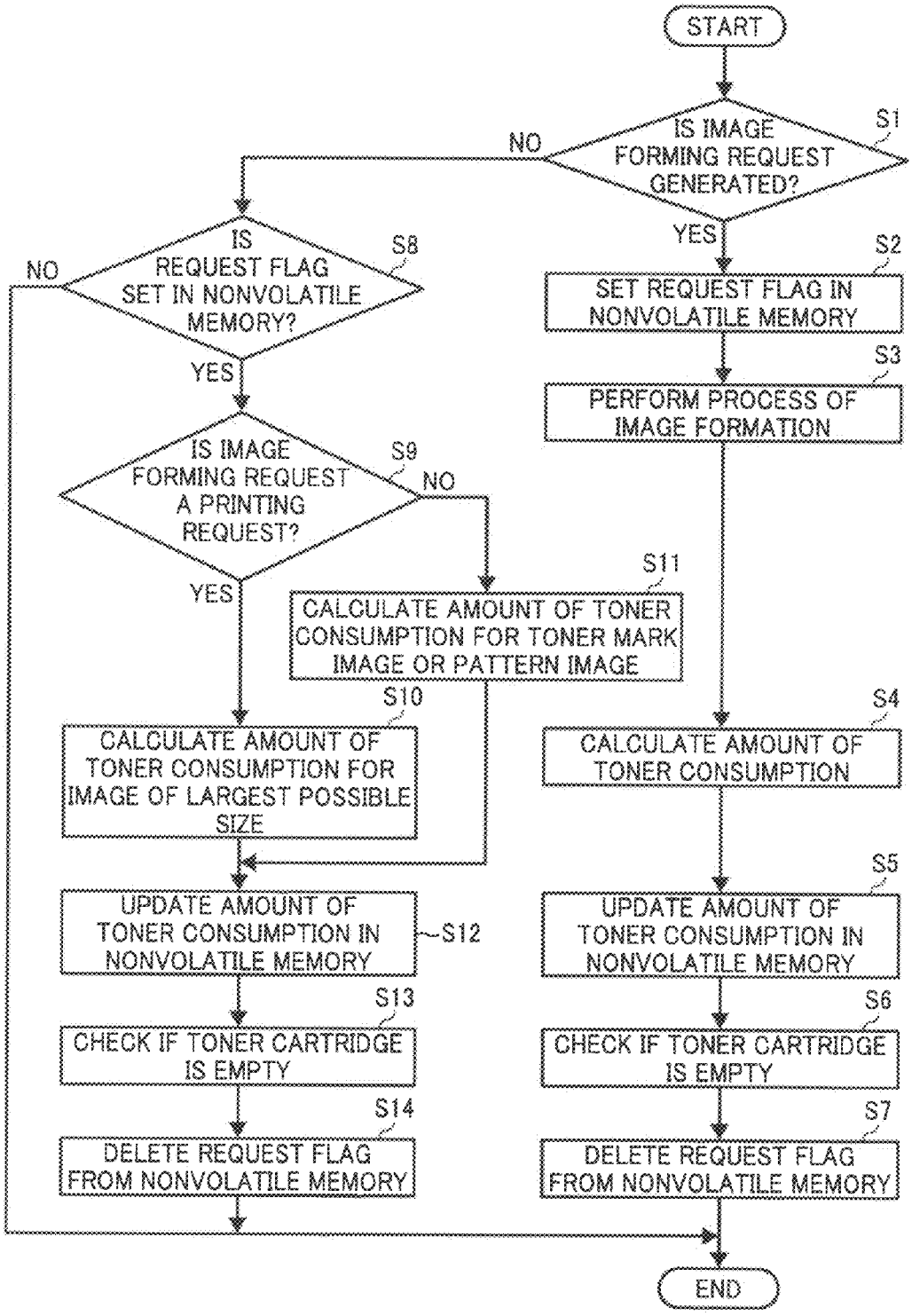
FIG. 2 is a flowchart for explaining a process of calculating amount of toner consumption during a process of image formation and accordingly updating a toner consumption database.

FIG. 2 is a flowchart for explaining a process of calculating the amount of toner consumption and accordingly updating the toner consumption database.

First, the control unit 20 determines whether an image forming request (i.e., a printing request from the print job managing unit 25, a toner-mark-image forming request from the color shift correcting unit 26, or a pattern image forming request from the process controller 27) is generated (Step S1). When an image forming request is determined to have been generated (Yes at Step S1), the control unit 20 sets a 2-bit request flag at a predetermined address in the memory unit 28 (hereinafter, "request flag address") (Step S2). The request flag indicates the type of image forming medium on which an image is to be formed according to the image forming request. That is, in the case of a printing request, the type of image forming medium is a sheet of printing paper; while in the case of a toner-mark-image forming request or a pattern image forming request, the type of image forming medium is the intermediate transfer belt 2. To identify the type of image forming medium according to the image forming request, e.g., a 2-bit value '01' is set at the request flag address in the case of a printing request, a 2-bit value '10' is set at the request flag address in the case of a toner-mark-image forming request, and a 2-bit value '11' is set at the request flag address in the case of a pattern image forming request. Subsequently, under the control of the control unit 20, the plotting unit 22 forms an image (a print image, a toner mark image, or a pattern image) according to the image forming request (Step S3). Upon formation of the image, the toner consumption monitoring unit 29 calculates the amount of toner consumption during the process of image formation (Step S4).

When the image forming request is a printing request, the total amount of toner consumption can be calculated by multiplying the total number of pixels, which corresponds to the paper size and the printing resolution specified in the printing request, with the amount of toner consumption per pixel. For example, when an image is printed on A4 size paper (2100 mm×297 mm) at the printing resolution of 600 dpi, then the total number of pixels is approximately 34802527 as calculated below:

$$210\times600/25.4\times297\times600/25.4\approx34802527\ [\text{dot}].$$

While calculating the total number of pixels, the blank margin of A4 size paper is not taken into consideration. Based on empirical data, 0.000002 milligrams of toner is required per pixel to form an image as described above. Considering that, the total amount of toner consumption when an image of uniform image density is formed in the printable area of A4 size paper is approximately 69.6 milligrams as calculated below:

$$34799360\times0.000002\approx69.6\ [\text{mg}].$$

Figure 5:
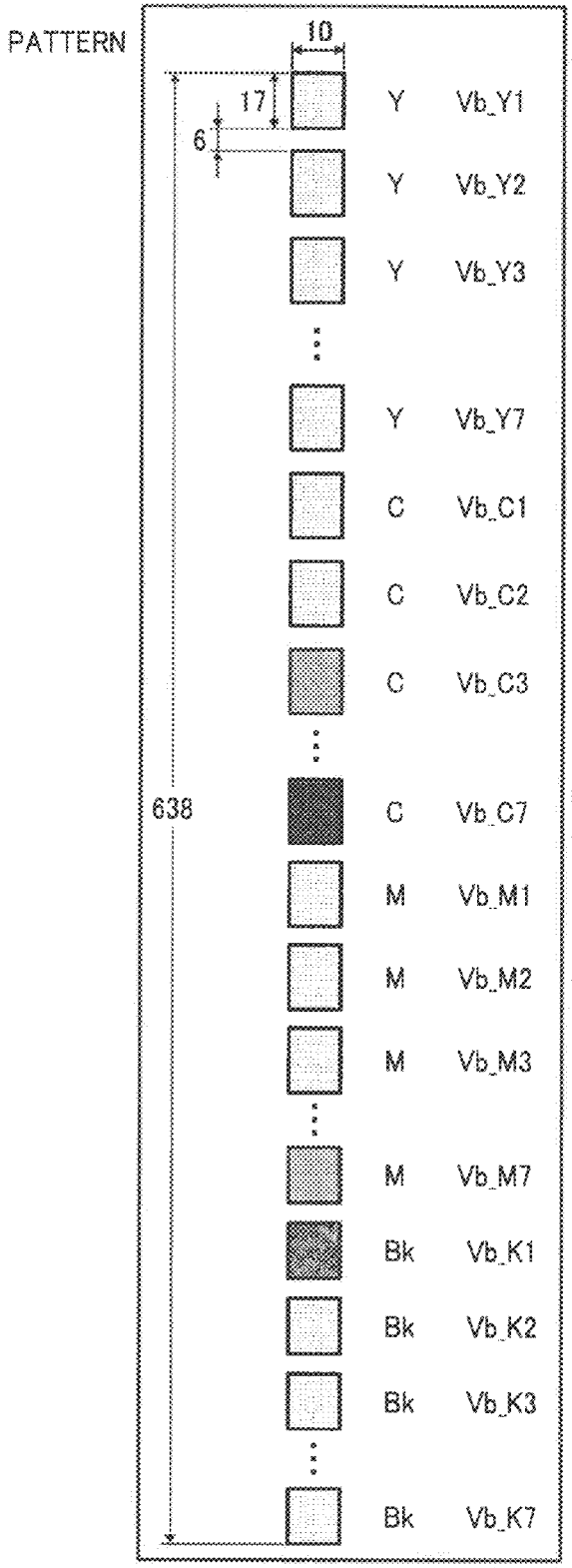
FIG. 5 is a schematic diagram of a pattern image used for process control adjustment.

FIG. 5 is a schematic diagram of a pattern image used for process control adjustment. As described above, according to a pattern image forming request, a pattern image is formed on the intermediate transfer belt 2. The pattern image includes seven patches having an area of 17 mm×10 mm for each color. When an image of uniform image density is formed in the printable area of A4 size paper, the number of pixels per color is approximately 664104 as calculated below:

$$17\times600/25.4\times10\times600/25.4\times7\approx664104\ [\text{dot}].$$

Accordingly, the total amount of toner consumption for the pattern image is approximately 1.328 milligrams as calculated below:

$$664104\times0.000002\approx1.328\ [\text{mg}].$$

Figure 6:
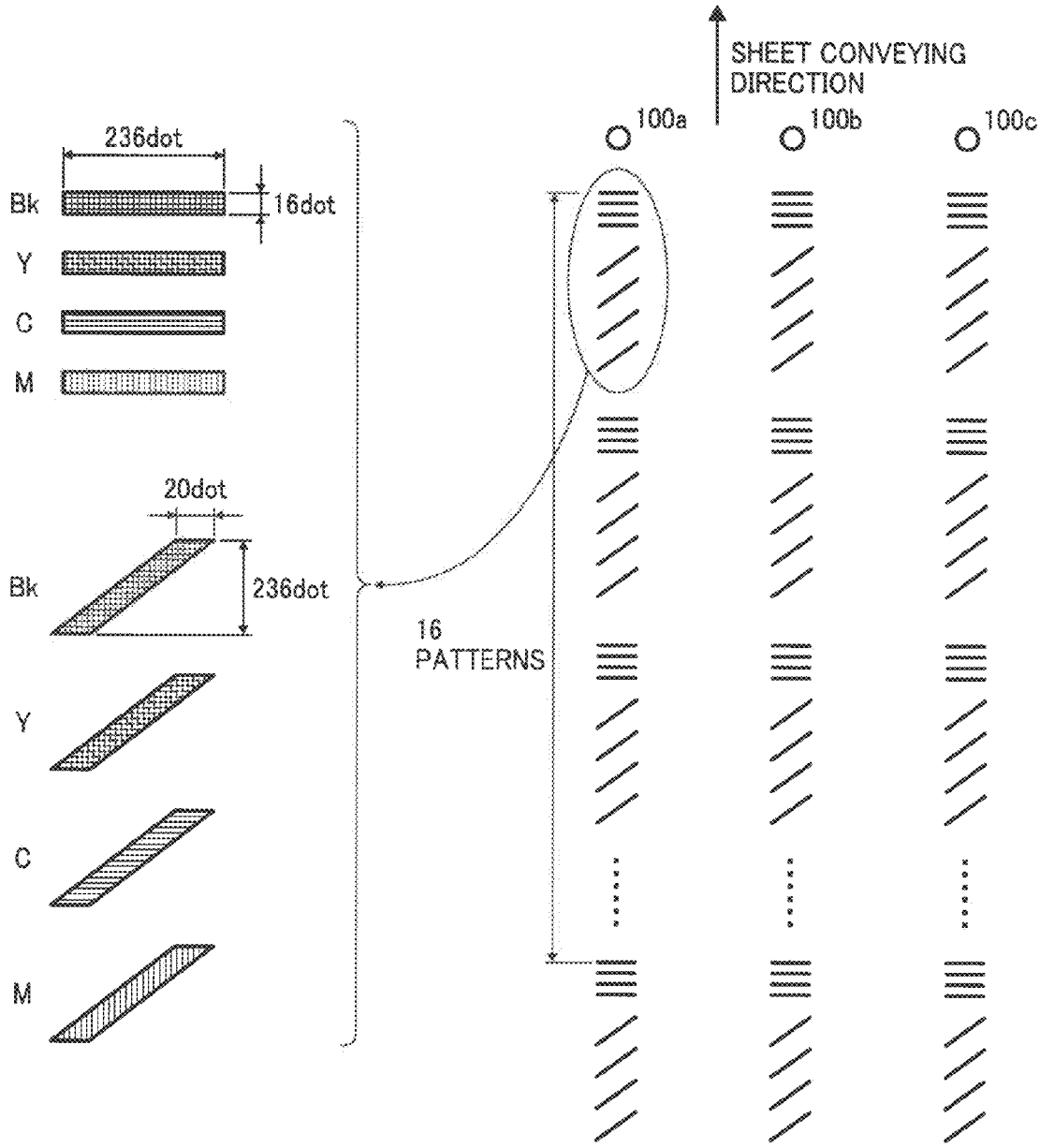
FIG. 6 is a schematic diagram of a toner mark image used for color shift correction.

FIG. 6 is a schematic diagram of a toner mark image. As described above, according to a toner-mark-image forming request, a toner mark image is formed on the intermediate transfer belt 2. As shown in FIG. 6, the toner mark image includes 16 rectangular patterns and 16 diagonal patterns of each color with respect to each of three detecting sensors 100*a*, 100*b*, and 100*c* arranged in the main scanning direction. Thus, the toner mark image includes in all 48 (16×3) patterns. The number of pixels in a rectangular pattern is 3774 calculated by multiplying 16 vertical pixels with 236 horizontal pixels. Similarly, the number of pixels in a diagonal pattern is 4720 calculated by multiplying 20 base pixels with 236 height pixels. Thus, the total number of pixels in a toner mark image is 407808 as calculated below:

$$(3776+4720)\times16\times3=407808\ [\text{dot}].$$

Accordingly, the total amount of toner consumption for the toner mark image is approximately 0.816 milligrams as calculated below:

$$407808\times0.000002\approx0.816\ [\text{mg}].$$

FIG. 7 is a table for explaining the total number of pixels used in the process of image formation according to each type of image forming request. The table shown in FIG. 7 and the amount of toner consumption per pixel is stored in the memory unit 28. The number of pixels shown in FIG. 7 is calculated at the printing resolution of 600 dpi. Meanwhile, when calculated at the printing resolution of 300 dpi, the number of pixels in both the main scanning direction and the sub-scanning direction decreases to ¼-th of the number of pixels at the printing resolution of 600 dpi but the amount of toner consumption per pixel quadruples from the amount of toner consumption per pixel at the printing resolution of 600 dpi. On the other hand, when calculated at the printing resolution of 1200 dpi, the number of pixels in both the main scanning direction and the sub-scanning direction quadruples from the number of pixels at the printing resolution of 600 dpi but the amount of toner consumption per pixel decreases to ¼-th of the amount of toner consumption per pixel at the printing resolution of 600 dpi. Thus, the total amount of toner consumption remains the same at each printing resolution. The amount of toner consumption per pixel at each printing resolution is separately stored in the memory unit 28. Thus, to calculate the total amount of toner consumption at any one of the printing resolutions 300 dpi, 600 dpi, and 1200 dpi, the total number of pixels given in FIG. 7 is multiplied with the stored amount of toner consumption per pixel at the corresponding printing resolution.

Reverting to the flowchart, upon calculating the amount of toner consumption, the toner consumption monitoring unit 29 adds the calculated amount of toner consumption to the data stored in the image storing unit 23 and updates the toner consumption database in the memory unit 28 (Step S5). Subsequently, the toner consumption monitoring unit 29 checks whether the updated amount of toner consumption has exceeded a predetermined threshold stored in advance in the memory unit 28, i.e., whether a toner cartridge has reached a cartridge empty condition (Step S6) and then overwrites the request flag address with a 2-bit value 1001 such that the request flag is deleted from the memory unit 28 (Step S7).

Meanwhile, when no image forming request is determined to have been generated (No at Step S1), the control unit 20 determines whether the request flag is set in the memory unit 28, i.e., whether any one of the 2-bit values '01', '10', and '11' is set at the request flag address (Step S8). When the request flag is determined not to have been set in the memory unit, i.e., when the 2-bit value '00' is determined to have been set at the request flag address (No at Step S8), the process is completed. On the other hand, when the request flag is determined to have been set in the memory unit (Yes at Step S8), the control unit 20 further determines whether the 2-bit value '01' is written at the request flag address, i.e., whether the image forming request is a printing request (Step S9). When the image forming request is determined to be a printing request (Yes at Step S9), the toner consumption monitoring unit 29 assumes that an image of uniform image density is formed on the printable area of a specified paper size and accordingly calculates the amount of toner consumption of each color (Step S10). The image of uniform image density formed on the printable area of a specified paper size is hereinafter referred to as a solid image. When the image forming request is determined not to be a printing request, i.e., when the image forming request is determined to be a toner-mark-image forming request or a pattern image forming request (No at Step S9), the toner consumption monitoring unit 29 calculates the amount of toner consumption of each color in the corresponding image (Step S11).

Subsequently, the toner consumption monitoring unit 29 adds the calculated amount of toner consumption to the data stored in the image storing unit 23 and updates the toner consumption database in the memory unit 28 (Step S12). The toner consumption monitoring unit 29 then checks whether the updated amount of toner consumption has exceeded the predetermined threshold stored in advance in the memory unit 28, i.e., whether a toner cartridge has reached a cartridge empty condition (Step S13) and then overwrites the request flag address with the 2-bit value '00' such that the request flag is deleted from the memory unit 28 (Step S14).

In this way, the request flag is set in the memory unit 28 as soon as an image forming request is generated. The toner consumption monitoring unit 29 calculates the amount of toner consumption based on the image forming request and the request flag. Upon completion of the process of image formation, the request flag is deleted from the memory unit 28. Thus, it becomes possible to determine whether the toner consumption database is correctly updated based on the request flag and accurately monitor the amount of toner consumption. Moreover, if the process of image formation is interrupted before the request flag is deleted from the memory unit 28, the toner consumption monitoring unit 29 updates the toner consumption database based on the request flag under an assumption that the solid image on a largest possible paper size is formed. In this way, estimating the amount of toner consumption on a higher side prevents toner deficiency upon resumption of the process of image formation and thus prevents deterioration in the image quality.

Meanwhile, the request flag can be expanded to a 3-bit value to include further details regarding the image forming request. That is, when the image forming request is a printing request, the request flag can include information regarding the paper size. For example, a 3-bit value '001' can be set when the sheet is A4 size paper, a 3-bit value '010' can be set when the sheet is B4 size paper, a 3-bit value '011' can be set when the sheet is legal-size paper. Moreover, a 3-bit value '110' can be set when the image forming request is a toner-mark-image forming request and a 3-bit value '111' can be set when the image forming request is a pattern image forming request. Thus, in the case of a printing request, it is possible for the toner consumption monitoring unit 29 to calculate the amount of toner consumption before the process of image formation is performed by using the information specified in the request flag. In other words, the toner consumption monitoring unit 29 can calculate the toner consumption database under an assumption that the solid image is formed on the paper size specified in the request flag. That estimate of the amount of toner consumption is more accurate than an estimate based on the assumption the solid image is formed on the largest possible paper size. As a result, it becomes possible to prevent deterioration in the image quality as well as prevent premature replacement of a toner cartridge that has not reached a cartridge empty condition. Meanwhile, instead of including information regarding the paper size in the request flag for a printing request, it is also possible to include information regarding the printing resolution. In that case, e.g., the 3-bit value '001' can be set when the printing resolution is 300 dpi, the 3-bit value '010' can be set when the printing resolution is 600 dpi, and the 3-bit value '011' can be set can be set when the printing resolution is 1200 dpi. Even in that case, it is possible for the toner consumption monitoring unit 29 to calculate the amount of toner consumption before the process of image formation is performed by using the information specified in the request flag. In other words, the toner consumption monitoring unit 29 can calculate the toner consumption database under an assumption that the solid image is formed on the largest possible paper size at the printing resolution specified in the request flag. Similarly, it is also possible to include information regarding the paper size as well as the printing resolution in the request flag such that an even more accurate estimate of the amount of toner consumption can be calculated.

Meanwhile, if a problem such as the temporary power discontinuity occurs at such a timing that the control unit 20 cannot obtain the information regarding the paper size or the printing resolution from a printing request, then it is not possible to include that information in the request flag set in the memory unit 28. In that case, in addition to the request flag, the control unit 20 can separately store the information regarding at least the paper size or the printing resolution in the memory unit 28 upon generation of the printing request. Thus, even when the request flag is deleted upon completion of the process of image formation, the toner consumption monitoring unit 29 can use the information regarding the paper size or the printing resolution while calculating the amount of toner consumption. As a result, an accurate estimate of the amount of toner consumption can be calculated thereby preventing deterioration in the image quality.

The process of image formation according to a toner-mark-image forming request or a pattern image forming request requires a longer time than the process of image formation according to a printing request. Moreover, in the process of image formation according to a toner-mark-image forming request or a pattern image forming request, the amount of toner consumption varies depending on the timing at which the process is interrupted. Thus, it is necessary to regularly monitor the elapse time of such a process of image formation. For that, in addition to the request flag, the elapse time of the process of image formation can also be stored in the memory unit 28. The toner consumption monitoring unit 29 can calculate the amount of toner consumption by using the request flag and the elapse time. As a result, an accurate estimate of the amount of toner consumption can be calculated when an image is formed according to a toner-mark-image forming request or a pattern image forming request. Upon completion of the process of image formation, the elapse time is deleted from the memory unit 28 along with the request flag.

Although the above description is given with reference to a process of monitoring the amount of toner consumption, it is also possible to monitor the degree of wear and tear of the photosensitive members 1*a* to 1*d*.

Thus, according to an aspect of the present invention, a request flag is set in a memory unit as soon as an image forming request is generated. Based on the image forming request and the request flag, amount of toner consumption during a process of image formation is calculated. Upon completion of the process of image formation, the request flag is deleted from the memory unit. Thus, it becomes possible to determine whether the amount of toner consumption is correctly updated based on the request flag and accurately monitor the amount of toner consumption.

Moreover, by estimating the amount of toner consumption on higher side prevents toner deficiency during the process of image formation thereby preventing deterioration in the image quality.

Furthermore, by accurately estimating the amount of toner consumption, it becomes possible to prevent deterioration in the image quality as well as prevent premature replacement of a toner cartridge that has not reached a cartridge empty condition.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on an image forming medium according to an image forming request, the image forming apparatus comprising:

an image forming unit that, upon receiving the image forming request, executes a process of image formation with respect to an image forming medium;

a storage unit that stores therein a request flag in the event that the image forming unit has received the image forming request, and stores therein a value indicative of degree of consumption of a consumable member used in the process of image formation; and a monitoring unit that monitors current degree of consumption of the consumable member, wherein the monitoring unit updates the value in the storage unit to a new value based on contents of the image forming request and whether the request flag is stored in the storage unit and deletes the request flag from the storage unit after updating the value.

2. The image forming apparatus according to claim 1, wherein the image forming request includes a type of the image forming medium, the request flag includes the type of the image forming medium included in the image forming request, and when the process of image formation is either one of not being performed by the image forming unit and interrupted, and when the request flag includes a type of the image forming medium, then the monitoring unit calculates the new value under an assumption that the process of image formation is performed with respect to a largest image formable area on the type of the image forming medium included in the request flag.

3. The image forming apparatus according to claim 1, wherein the image forming request includes a type and a size of the image forming medium, and the request flag includes the type and the size of the image forming medium included in the image forming request.

4. The image forming apparatus according to claim 3, wherein when the process of image formation is either one of not being performed by the image forming unit and interrupted, and when the request flag includes a type and a size of the image forming medium, then the monitoring unit calculates the new value under an assumption that the process of image formation is performed with a uniform density with respect to an image formable area on the type of the image forming medium included in the request flag and within the size of the image forming medium included in the request flag.

5. The image forming apparatus according to claim 1, wherein the image forming request includes a type of the image forming medium and an image resolution of the image to be formed on the image forming medium, and the request flag includes the type of the image forming medium and the image resolution of the image included in the image forming request.

6. The image forming apparatus according to claim 5, wherein when the process of image formation is either one of not being performed by the image forming unit and interrupted, and when the request flag includes the type of the image forming medium and the image resolution of the image, then the monitoring unit calculates the new value under an assumption that the process of image formation is performed with respect to the type of the image forming medium included in the request flag and at specified image resolution.

7. The image forming apparatus according to claim 1, wherein the image forming request includes a type and a size of the image forming medium, the request flag includes the type of the image forming medium included in the image forming request, the storage unit stores therein the size of the image forming medium included in the image forming request, when the process of image formation is either one of not being performed by the image forming unit and interrupted, when the request flag indicating the specified type of the image forming medium is set in the storage unit, and when specified size of the image forming medium is stored in the storage unit, then the monitoring unit updates the degree of consumption of the consumable member under an assumption that the process of image formation of uniform image density is performed with respect to an image formable area within the specified size of the specified type of the image forming medium, and subsequently deletes the request flag from the storage unit.

8. The image forming apparatus according to claim 1, wherein the request flag indicates a type of the image forming medium specified in the image forming request, upon generation of the image forming request, the image forming unit sets the request flag indicating specified type of the image forming medium in the storage unit and separately stores an image resolution of the image forming medium specified in the image forming request in the storage unit, and when the process of image formation is either one of not being performed by the image forming unit and interrupted, when the request flag indicating the specified type of the image forming medium is set in the storage unit, and when specified image resolution of the image forming medium is stored in the storage unit, then the monitoring unit updates the degree of consumption of the consumable member under an assumption that the process of image formation is performed with respect to the specified type of the image forming medium at the specified image resolution, and subsequently deletes the request flag from the storage unit.

9. The image forming apparatus according to claim 1, wherein when a type of image to be formed in the process of image formation is specified as a correction image in an image forming request, then, upon generation of the image forming request, the image forming unit stores specified type of image in the storage unit.

10. The image forming apparatus according to claim 9, wherein when the process of image formation is either one of not being performed by the image forming unit and interrupted, when the specified type of image stored in the storage unit is a correction image, and when the request flag indicating that the image forming request is generated is set in the storage unit, then the monitoring unit updates the degree of consumption of the consumable member under an assumption that an image of the specified type is formed.

11. The image forming apparatus according to claim 9, wherein during the process of image formation of the image of the specified type, the image forming unit periodically stores an elapse time of the process of image formation in the storage unit.

12. The image forming apparatus according to claim 11, wherein when the process of image formation of the image of the specified type is either one of not being performed by the image forming unit and interrupted, when the specified type of image stored in the storage unit is a correction image, when the elapse time of the process of image formation is stored in the storage unit, and when the request flag indicating that the image forming request is generated is set in the storage unit, then the monitoring unit updates the degree of consumption of the consumable member under an assumption that the image of the specified type is formed.

13. The image forming apparatus according to claim 1, wherein the consumable member is an image forming material and the degree of consumption is amount of consumption of the image forming material.

14. The image forming apparatus according to claim 1, wherein the consumable member is an image carrying member and the degree of consumption is degree of wear and tear of the image carrying member.

15. An image forming method of an image forming apparatus for forming an image on an image forming medium according to an image forming request, comprising:

executing, at an image forming unit upon receiving the image forming request, a process of image formation with respect to an image forming medium;

storing, in a storage unit, data;

monitoring, at a monitoring unit, a current degree of consumption of a consumable member;

storing, in the storage unit, a request flag in the event that the image forming unit has received the image forming request;

storing, in the storage unit, a value indicative of degree of consumption of the consumable member used in the process of image formation;

updating, using the monitoring unit, the value in the storage unit to a new value based on contents of the image forming request and whether the request flag is stored in the storage unit; and deleting the request flag from the storage unit after updating the value.

* * * * *